US007402957B2

(12) United States Patent
Shimura et al.

(10) Patent No.: US 7,402,957 B2
(45) Date of Patent: Jul. 22, 2008

(54) INVERTER CIRCUIT, BACKLIGHT ASSEMBLY, AND LIQUID CRYSTAL DISPLAY WITH BACKLIGHT ASSEMBLY

(75) Inventors: Tatsuhisa Shimura, Tokyo (JP); Takashi Kinoshita, Tokyo (JP); Osamu Sengoku, Tokyo (JP)

(73) Assignee: Samsung Electronics Co., Ltd. (KR)

( * ) Notice: Subject to any disclaimer, the term of this patent is extended or adjusted under 35 U.S.C. 154(b) by 124 days.

(21) Appl. No.: 11/521,884

(22) Filed: Sep. 15, 2006

(65) Prior Publication Data

US 2007/0120499 A1 May 31, 2007

(30) Foreign Application Priority Data

Nov. 30, 2005 (KR) ..... 10-2005-0115621

(51) Int. Cl.
*H05B 37/00* (2006.01)

(52) U.S. Cl. ..... 315/276; 315/277; 315/278; 315/279

(58) Field of Classification Search ..... 315/276, 315/277, 278, 279, 312, 313, DIG. 5
See application file for complete search history.

(56) References Cited

U.S. PATENT DOCUMENTS 7,250,731 B2 * 7/2007 Jin ..... 315/282
2005/0099143 A1 * 5/2005 Kohno ..... 315/312

FOREIGN PATENT DOCUMENTS

| | | |
|---|---|---|
| JP | 2004335443 A | 11/2004 |
| JP | 2005-183099 | 7/2005 |
| JP | 2005203347 A | 7/2005 |
| KR | 10-2003-0031406 | 4/2003 |
| KR | 10-2005-0068170 | 7/2005 |

* cited by examiner

*Primary Examiner*—David H Vu
(74) *Attorney, Agent, or Firm*—Cantor Colburn LLP

(57) ABSTRACT

In an inverter circuit, inverter transformers supply AC voltage to discharge tubes. The inverter transformers are arranged such that the AC voltage at a respective first terminal of each secondary coil has an opposite polarity with respect to a corresponding second terminal of each secondary coil. Balance transformers have primary coils inserted in series between a reference terminal of the secondary coils of the inverter transformers and ground. The secondary coils of the balance transformers are connected in series to form a loop. One node of the loop is grounded and a voltage detection node is located on the loop. At least one secondary coil of the secondary coils of the balance transformers is interposed between the grounded node of the loop and the voltage detection node. Thus, an abnormal state or condition, such as an open circuit or a short circuit may be detected.

25 Claims, 13 Drawing Sheets

INVERTER CIRCUIT, BACKLIGHT ASSEMBLY, AND LIQUID CRYSTAL DISPLAY WITH BACKLIGHT ASSEMBLY

CROSS-REFERENCE TO RELATED APPLICATION

This application claims priority to Korean Patent Application No. 2005-115621 filed on Nov. 30, 2005 and all the benefits accruing therefrom under 35 USC § 119, the entire contents of which are incorporated herein by reference.

BACKGROUND OF THE INVENTION

1. Field of the Invention

The present invention relates to electronic display devices. More particularly, the present invention relates to an inverter circuit capable of driving a discharge tube, a backlight assembly including the inverter circuit, and a liquid crystal display ("LCD") including the backlight assembly.

2. Description of the Related Art

Illustratively, discharge tubes may be implemented using cold cathode fluorescent lamps ("CCFLs") as described hereinafter, but it is to be clearly understood that the present invention is not limited to CCFLs. For example, the present invention may be implemented in a system that turns on a plurality of discharge tubes in response to an applied alternating current ("AC") voltage, wherein these discharge tubes are not construed as being limited to the CCFL.

A conventional LCD uses a CCFL as a backlight. In recent years, large LCD televisions have been developed which use correspondingly large LCD displays. Accordingly, plural CCFLs are used to provide a backlight for these large LCD displays.

FIG. 1 is a schematic view illustrating light emitting properties for a prior art CCFL 301. The CCFL 301 is a type of fluorescent lamp that operates in a normal glow discharge region. A phosphor 322 is coated inside a glass tube 321 of the CCFL 301, and a slight amount of inert gas and mercury are sealed within the glass tube 321. By applying an AC voltage between electrodes 328 disposed on both sides of the CCFL 301, a glow discharge occurs in mercury vapor. Due to this discharge, mercury 323 is excited and an ultraviolet ray 324 is generated. The phosphor 322 coated in the glass tube 321 is excited by the ultraviolet ray 324 to a high energy level. Light is emitted at a wavelength corresponding to an energy difference occurring when the excited phosphor atoms return to a low energy level from the high energy level. The CCFL 301 emits light having a wavelength determined by the phosphor atom. Also, the CCFL 301 has a negative resistance characteristic in that impedance is reduced as a function of increasing current flowing therethrough. Also, because it is difficult to fabricate the CCFLs having the same (or uniform) impedance, the impedances of the CCFLs are dispersed throughout an arbitrary range.

The following approaches have been proposed to solve problems occurring when the number of CCFLs increases. For example, a structure may be employed in which a number of inverter transformers increases according to the number of CCFLs used. As illustrated in the prior art configuration of FIG. 2, a plurality of inverter transformers 900A to 900N is provided to correspond to CCFLs 301 to 310, respectively. As the number of inverter transformers increases, the inverter transformers occupy an undesirably large area on a printed substrate. Therefore, a size of the inverter circuit becomes large.

To reduce the size of the inverter circuit, driving a plurality of CCFLs 301 to 310 using a single inverter transformer may be considered as illustrated in the prior art configuration of FIG. 3.

However, the structure of FIG. 3 causes interference with a driving circuit of the LCD because the CCFLs 301 to 310 are driven by a sinusoidal AC voltage 94A of a same polarity. Consequently, noise such as fringe interference is observed on the display screen. This noise can be eliminated or reduced by providing a differential type inverter transformer 901 as illustrated in the prior art configuration of FIG. 4. That is, the inverter transformer 901 is configured such that sinusoidal AC voltages 95 and 96 generated from two secondary coils have opposite polarities.

However, as described above, two secondary coils have to be constructed to provide opposite polarities with respect to each other in order to obtain voltages of reverse phase at the secondary sides of the inverter transformer 901 for a differential voltage implementation. It is difficult to obtain the AC voltages 95 and 96 for these reverse phases from the two secondary coils. When the AC voltages 95 and 96 of the reverse phases generated from the secondary coils of the inverter transformer 901 are not uniform, variations are observed in the currents flowing through the CCFLs 301 to 310, thereby causing bright areas or dim areas or both.

Also, as described above, the CCFLs have a negative resistance characteristic. When the CCFLs 301 to 310 are connected in parallel to the inverter transformer 901, it is assumed that a current begins to flow through a specific CCFL having a relatively low impedance compared with the remaining CCFLs of CCFLs 301 to 310. In this case, current is concentrated in the specific CCFL because the current flows more easily as the resistance of the specific CCFL decreases. As a result, the bright areas occur at one or more CCFLs, thereby shortening the lifespan of the CCFLs.

To avoid the aforementioned problem, a balance circuit may be connected in series with the CCFLs. FIG. 5 is a prior art circuit diagram illustrating an example of a balance circuit 400 connected to CCFLs 310 to 310. When a current flows through an arbitrary CCFL, a current flows through a primary coil of a balance transformer (for example, one of balance transformers 401 to 410 in FIG. 5) connected in series with the CCFL. This causes a current to flow through a secondary coil of the balance transformer. Since the secondary coil of the balance transformer is connected in series with the secondary coils of the remaining balance transformers, a current flowing through the secondary coils of the balance transformers forces a current to flow through the primary coils of the balance transformers 401 to 410. Consequently, currents of the respective CCFLs 301 to 310 are controlled in the same manner. As illustrated in FIG. 5, a loop formed by the secondary coils of the balance transformers 401 to 410 is grounded. A detected voltage is detected at a contact node (detection node) 501 in a state wherein a secondary coil of at least one balance transformer is interposed between a grounded node and the contact node (detection node) 501. The detected voltage is a voltage that is necessary for the balance transformers 401 to 410 to maintain balance of the CCFLs 301 to 310. The magnitude of the detected voltage is different according to the dispersion of the resistances including the negative resistance characteristic of the CCFLs. Using this voltage observation, an open circuit or a short circuit caused by malfunction of the CCFLs can be detected. That is, when the open circuit or the short circuit occurs, a higher voltage compared to a voltage at a normal state is generated at the detection node 501 so as to maintain the balance of the balance transformers 401 to 410.

[Related reference 1] Japanese Patent Laid-open Publication No. 2004-335443

[Related reference 2] Japanese Patent Laid-open Publication No. 2005-203347

When the impedance of a CCFL increases because the lifetime of the CCFL is nearly at an end, the Q of an inverter resonance circuit becomes high so that a relatively high voltage is generated. Therefore, a corona discharge is easily generated between a line disposed between the secondary coil of the inverter transformer and another line. The corona discharge gradually carbonizes an insulating coating of the lines, thereby causing short circuiting of the lines.

The balance transformer 400 used in the inverter circuit for turning on the CCFLs 301 to 310 for the backlight of the conventional LCD of FIG. 5 is connected to terminals of the CCFLs 301 to 310 which are opposite with respect to the inverter transformer 901. When an abnormal state such as a current concentration on a specific CCFL occurs, the balance transformer 400 generates a higher voltage relative to a normal state at the voltage detection node 501. Automatic operation of the control circuit is possible by detecting the voltage at the voltage detection contact point 501. However, when a high voltage discharge such as a corona discharge occurs between a line disposed between the secondary coil of the inverter transformer 901 and the CCFLs 301 to 310 and another line, this high voltage discharge does not influence the balance between the CCFLs 301 to 310. For this reason, it is virtually impossible to detect an abnormal state such as a high voltage discharge occurring in a voltage detection node of the balance transformers 401 to 410 connected to terminals of the CCFLs 301 to 310.

SUMMARY OF THE INVENTION

Exemplary embodiments of the present invention provide an inverter circuit capable of detecting an abnormal state such as a high voltage discharge in a circuit to drive a discharge tube.

Exemplary embodiments of the present invention also provide a backlight assembly including the foregoing inverter circuit.

Exemplary embodiments of the present invention also provide a liquid crystal display using the aforementioned backlight assembly.

Pursuant to one illustrative aspect of the present invention, an inverter circuit includes a plurality of inverter transformers that supply AC voltage to a plurality of discharge tubes, and a plurality of balance transformers having primary coils inserted in series between a reference terminal of the secondary coils of the inverter transformers and ground. The inverter transformers are arranged such that the AC voltage at a respective first terminal of each secondary coil has a substantially opposite polarity with respect to the AC voltage at a corresponding second terminal of each secondary coil. The secondary coils of the balance transformers are connected in series to form a loop. One node of the loop is grounded, and a voltage detection node is located on the loop. At least one secondary coil of the secondary coils of the balance transformers is interposed between the grounded node of the loop and the voltage detection node.

The voltage detection node is a circuit node on the loop where half of the secondary coils of the balance transformers are interposed between the voltage detection node and the grounded node.

Each of the inverter transformers may include two primary coils and two secondary coils, wherein a first secondary coil of the two secondary coils is arranged to have an AC voltage of opposite polarity with respect to a second secondary coil of the two secondary coils.

Each of the inverter transformers may include a single primary coil and two secondary coils, wherein a first secondary coil of the two secondary coils is arranged to have an AC voltage of opposite polarity with respect to a second secondary coil of the two secondary coils.

The discharge tubes include a first discharge tube and a second discharge tube. The first discharge tube, the primary coils of the balance transformers, and the second discharge tube are connected in series across opposite polarity AC voltages outputted from the secondary coils of the inverter transformers. The secondary coils of the balance transformers are connected in series to form the loop.

Respective primary coils of the balance transformers are connected in series between ground and corresponding terminals of each of the discharge tubes that are not connected to the inverter transformers.

The inverter circuit further includes a comparator to compare the voltage at the voltage detection node with a predetermined reference voltage. The comparator generates a control voltage at either a low level or a high level when the voltage of the voltage detection node is higher than the reference voltage.

The inverter circuit compares the voltage of the voltage detection node with the reference voltage and adjusts a current supplied to the discharge tubes based on the comparison, wherein the adjustment includes cutting off a voltage supplied to the discharge tubes as a function of the comparison.

In another aspect of the present invention, a backlight assembly includes a plurality of discharge tubes, a plurality of inverter transformers supplying AC voltage to the plurality of discharge tubes, and a plurality of respective balance transformers having primary coils inserted in series between corresponding reference terminals of the secondary coils of the inverter transformers and ground. The inverter transformers are arranged such that the AC voltage at a first terminal of each secondary coil has an opposite polarity with respect to the AC voltage at a second terminal of each secondary coil. The secondary coils of the balance transformers are connected in series to form a loop. One circuit node of the loop is grounded and a voltage detection node is located on the loop. At least one secondary coil of the secondary coils of the balance transformers is interposed between the grounded node of the loop and the voltage detection node.

The discharge tubes may be cold cathode fluorescent lamps (CCFLs).

The voltage detection node is a circuit node on the loop where half of the secondary coils of the balance transformers are interposed between the voltage detection node and the grounded node.

Each of the inverter transformers may have two primary coils and two secondary coils, wherein a first secondary coil of the two secondary coils is arranged to have an AC voltage of opposite polarity with respect to a second secondary coil of the two secondary coils.

Each of the inverter transformers may have a single primary coil and two secondary coils, wherein a first secondary coil of the two secondary coils is arranged to have an AC voltage of opposite polarity with respect to a second secondary coil of the two secondary coils.

The discharge tubes include a first discharge tube and a second discharge tube. The first discharge tube, the primary coils of the balance transformers, and the second discharge tube are connected in series across opposite polarity AC voltages outputted from the secondary coils of the inverter transformers. The secondary coils of the balance transformers are connected in series to form the loop.

The primary coils of respective balance transformers are connected in series between ground and corresponding terminals of each discharge tube that are not connected to any inverter transformer.

The backlight assembly further includes a comparator to compare the voltage of the voltage detection node with a predetermined reference voltage. The comparator generates a control voltage at either a low level or a high level when the voltage of the voltage detection node is higher than the reference voltage.

The backlight assembly compares the voltage of the voltage detection node with the reference voltage, adjusts a current supplied to the discharge tubes based on the comparison, and may cut off a voltage supplied to the discharge tubes based on the comparison.

Pursuant to another illustrative embodiment of the present invention, a liquid crystal display includes a liquid crystal panel that displays an image and an inverter circuit. The liquid crystal panel includes a plurality of gate lines, a plurality of data lines approximately orthogonal to the gate lines, a plurality of switching elements connected to the gate lines and the data lines, and a liquid crystal element connected to the switching elements. The inverter circuit includes a plurality of inverter transformers that supplies AC voltages to a plurality of discharge tubes, and a plurality of balance transformers having primary coils inserted in series between a reference terminal of each secondary coil of the inverter transformers and a ground. The inverter transformers are arranged such that a first terminal of each secondary coil has an AC voltages of opposite polarity with respect to a second terminal of each secondary coil. The secondary coils of the balance transformers are connected in series to form a loop. One node of the loop is grounded and a voltage detection node is located on the loop. At least one secondary coil of the secondary coils of the balance transformers is interposed between the grounded node of the loop and the voltage detection node.

Liquid crystal displays as described herein may be used for liquid crystal monitors.

Liquid crystal displays as described herein may be used in liquid crystal television sets.

BRIEF DESCRIPTION OF THE DRAWINGS

The accompanying drawings, which are included to provide a further understanding of the invention, illustrate embodiment(s) of the invention and together with the description serve to explain the principles of the invention. In the drawings.

DETAILED DESCRIPTION OF THE INVENTION

Figure 1:
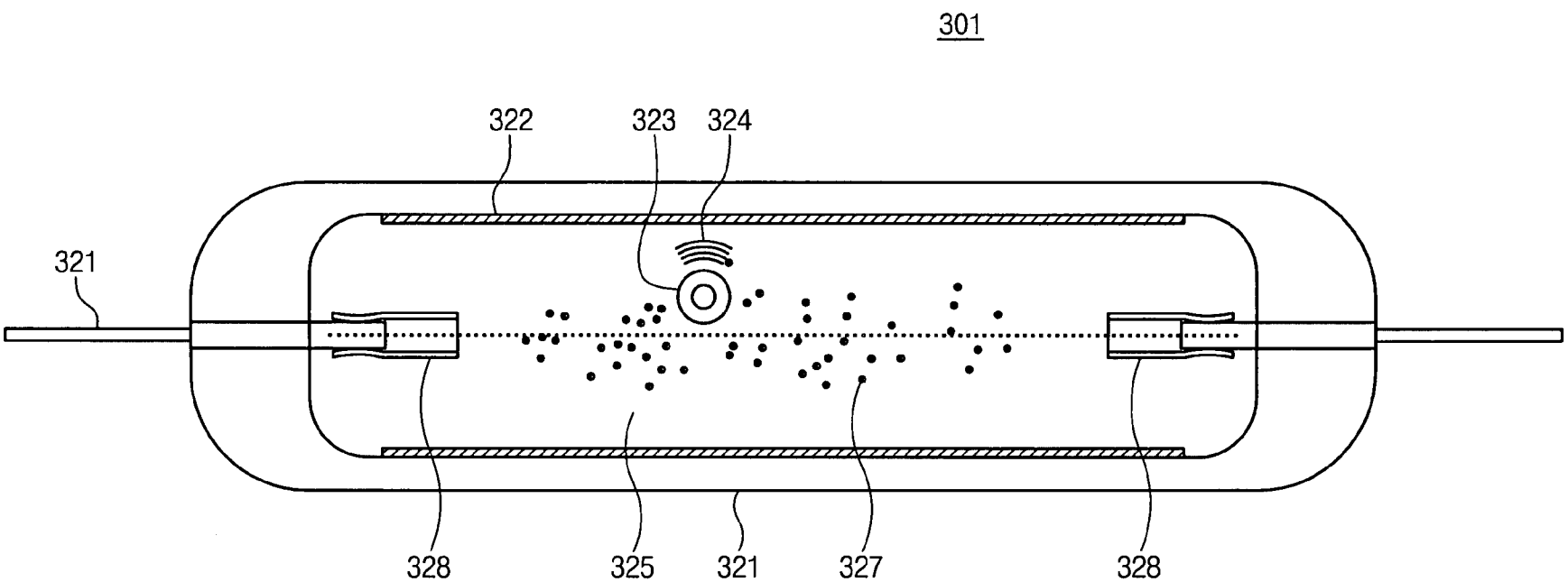
Fig. 1 (PRIOR ART)
FIG. 1 is a prior art schematic diagram illustrating a light emitting property of a CCFL.
Figure 2:
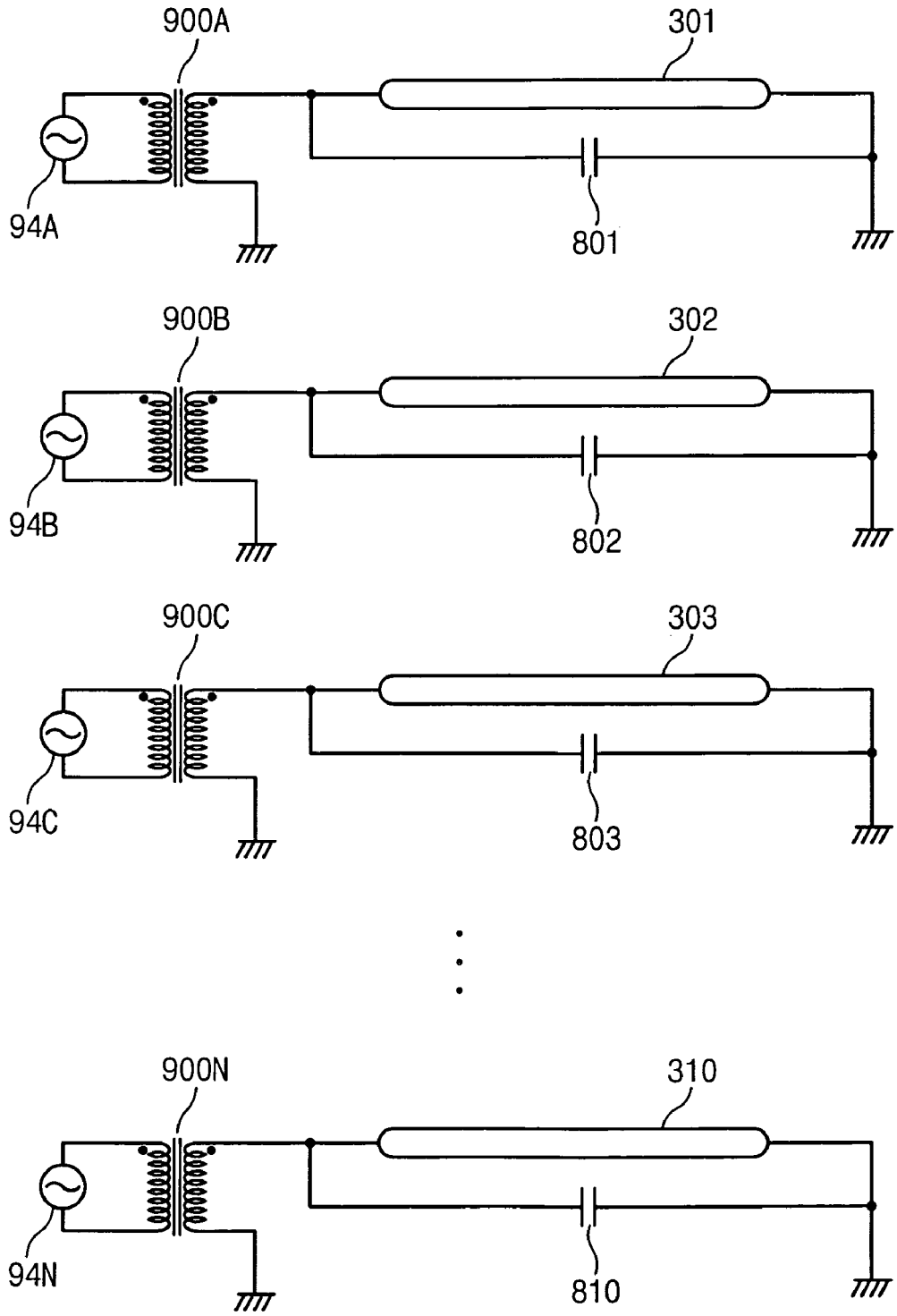
Fig. 2 (PRIOR ART)
FIG. 2 is a prior art circuit diagram illustrating a plurality of CCFLs that are driven using a one-side-high voltage driving method.
Figure 3:
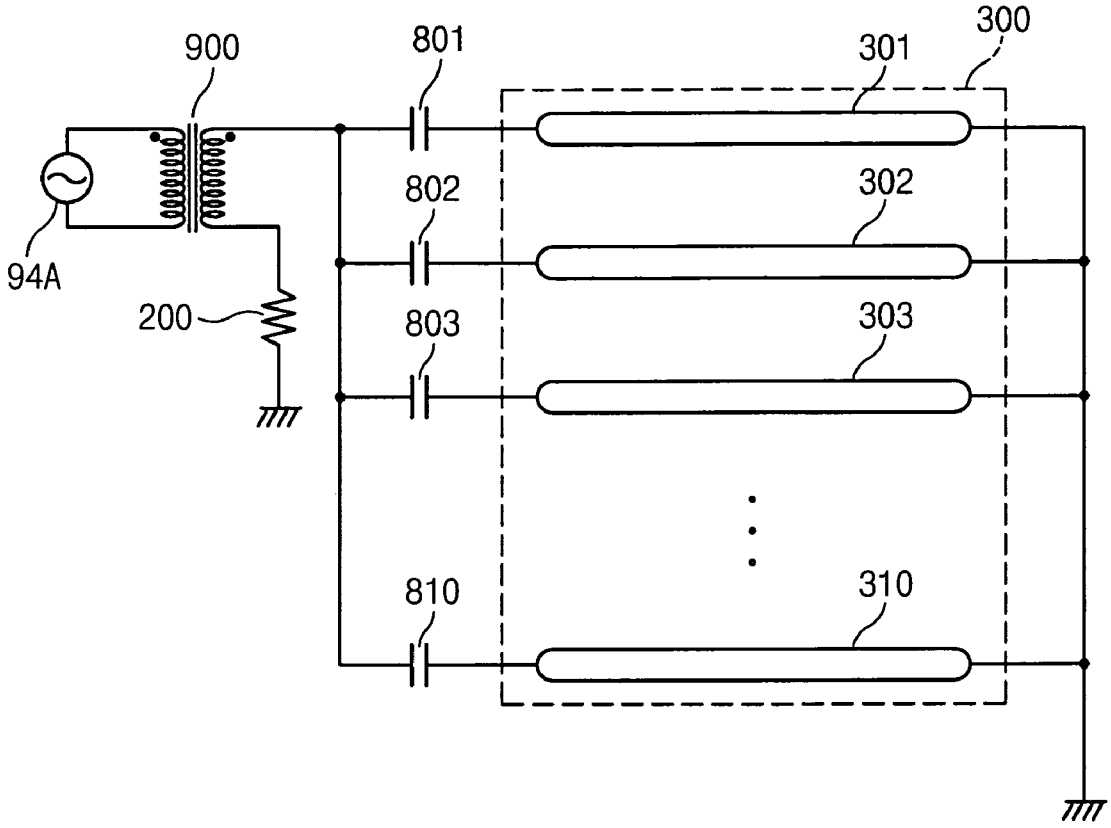
Fig. 3 (PRIOR ART)
FIG. 3 is a prior art circuit diagram illustrating a conventional example of driving a plurality of CCFLs in parallel using a one-side-high voltage driving method.
Figure 4:
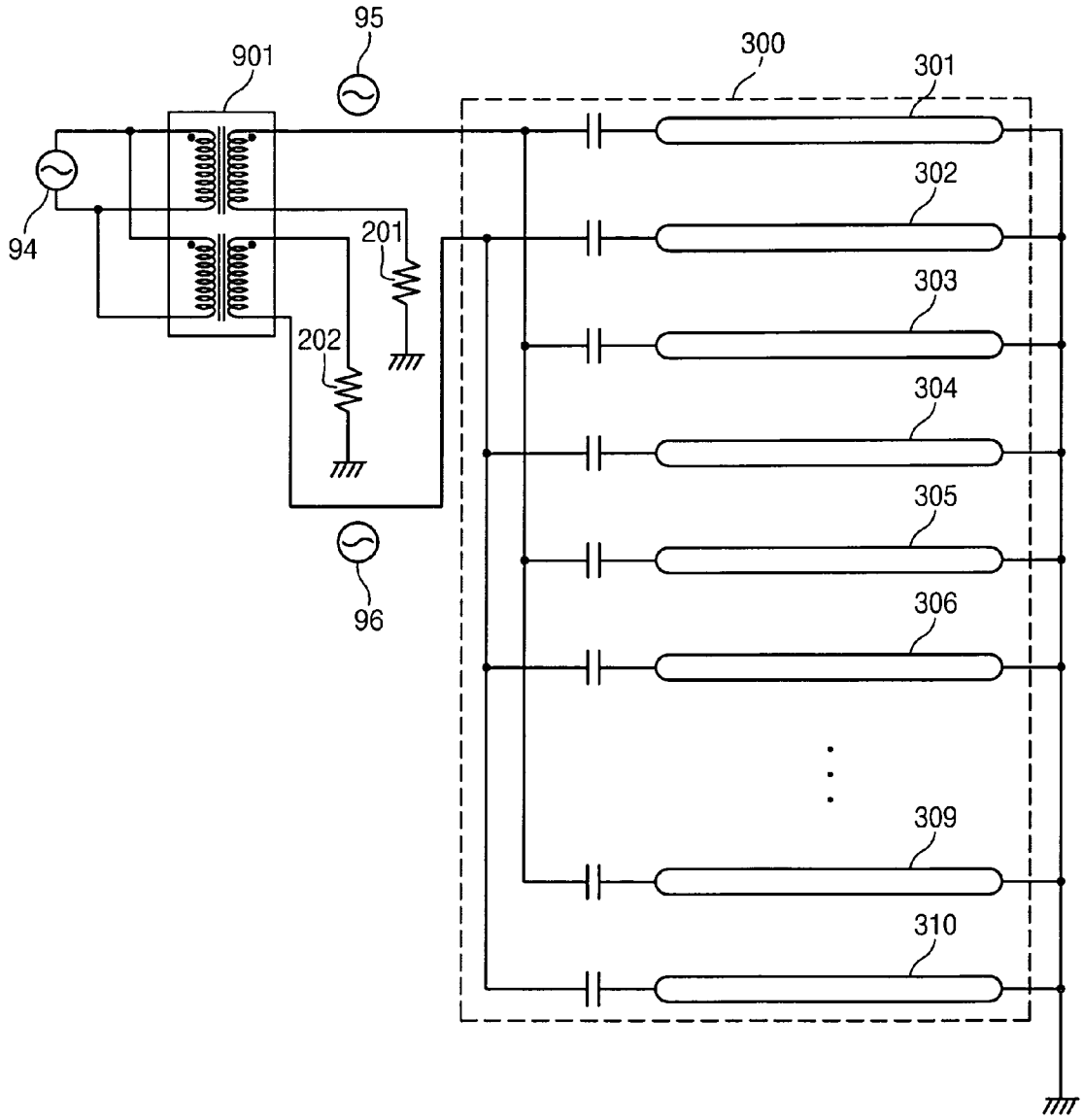
Fig. 4 (PRIOR ART)
FIG. 4 is a prior art circuit diagram illustrating a conventional example of driving a plurality of CCFLs in parallel using a differential voltage driving method.
Figure 5:
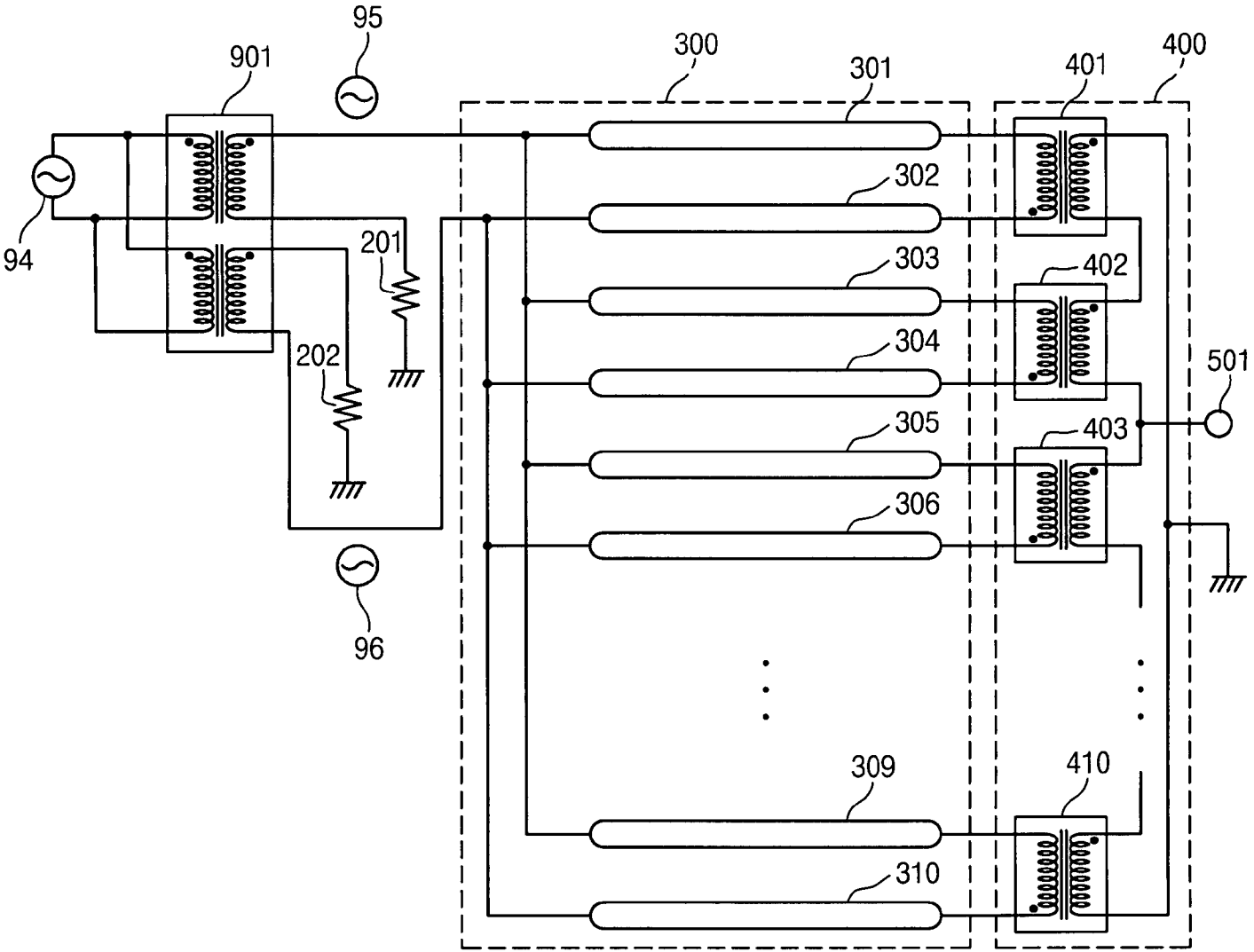
Fig. 5 (PRIOR ART)
FIG. 5 is a prior art circuit diagram of a conventional balance transformer for providing uniformity among a plurality of discharge tube currents by driving a plurality of CCFLs in parallel using the differential voltage driving method.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, the present invention will be described in detail with reference to the accompanying drawings. However, the present invention is not limited to the embodiments illustrated hereinafter, and the embodiments herein are rather introduced to provide an easy and complete understanding of the scope and spirit of the present invention.

Figure 6:
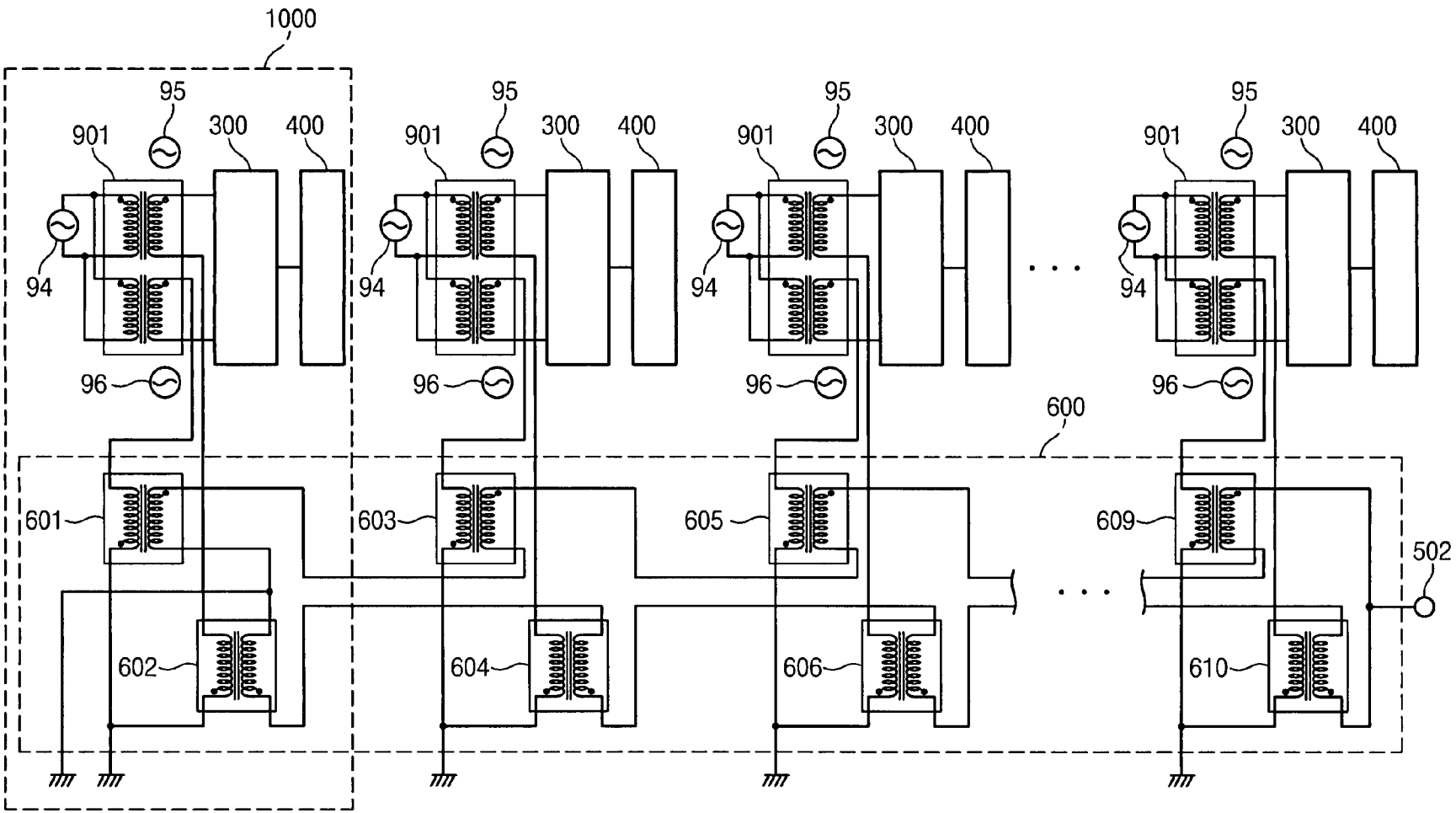
FIG. 6 is a circuit diagram showing a plurality of balance transformers configured according to exemplary embodiments of the present invention.
Figure 7:
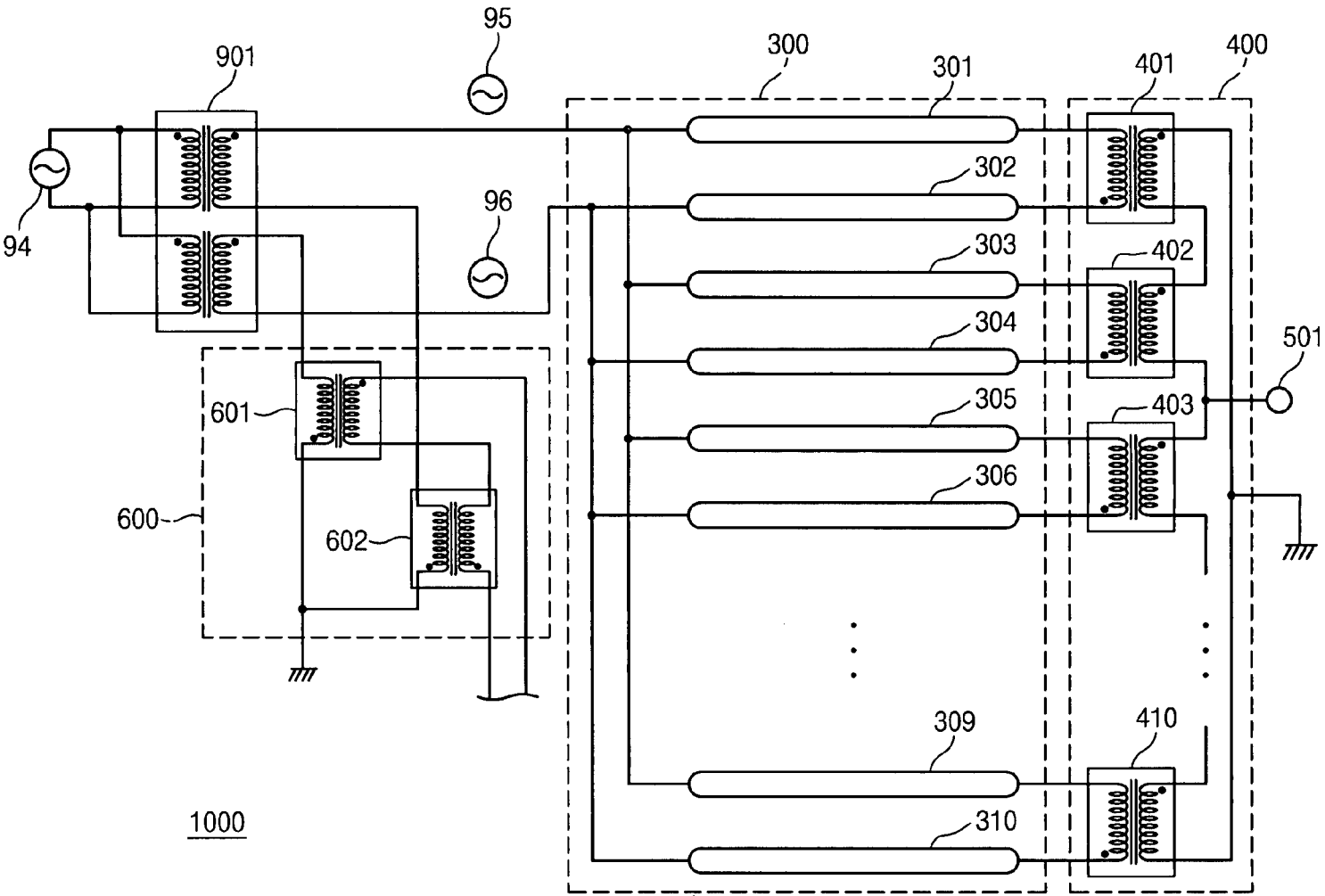
FIG. 7 is a circuit diagram showing an exemplary embodiment for the inverter circuit and backlight assembly of FIG. 6.
Figure 11:
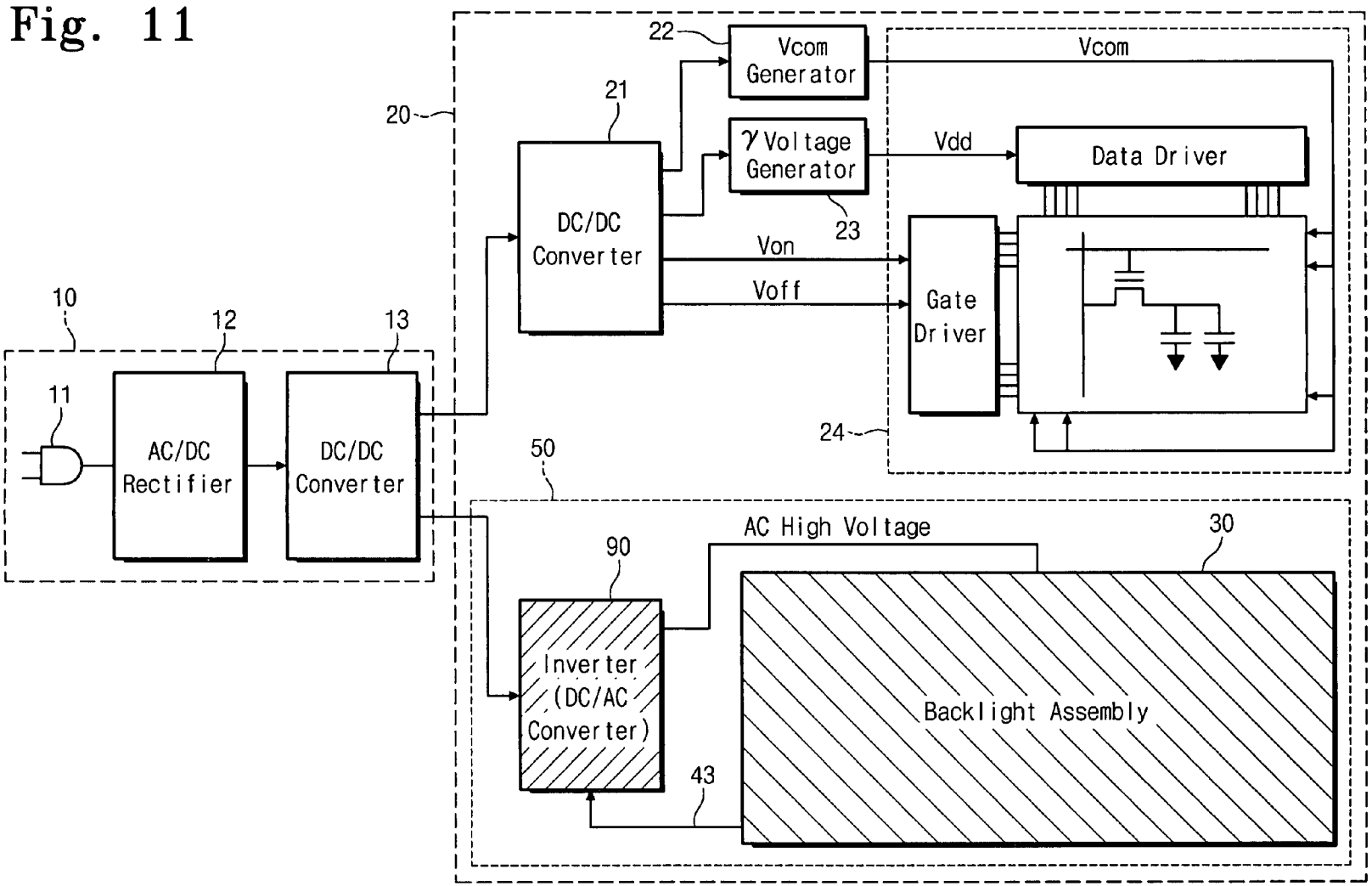
FIG. 11 is a block diagram showing an exemplary embodiment of an LCD display.
Figure 12:
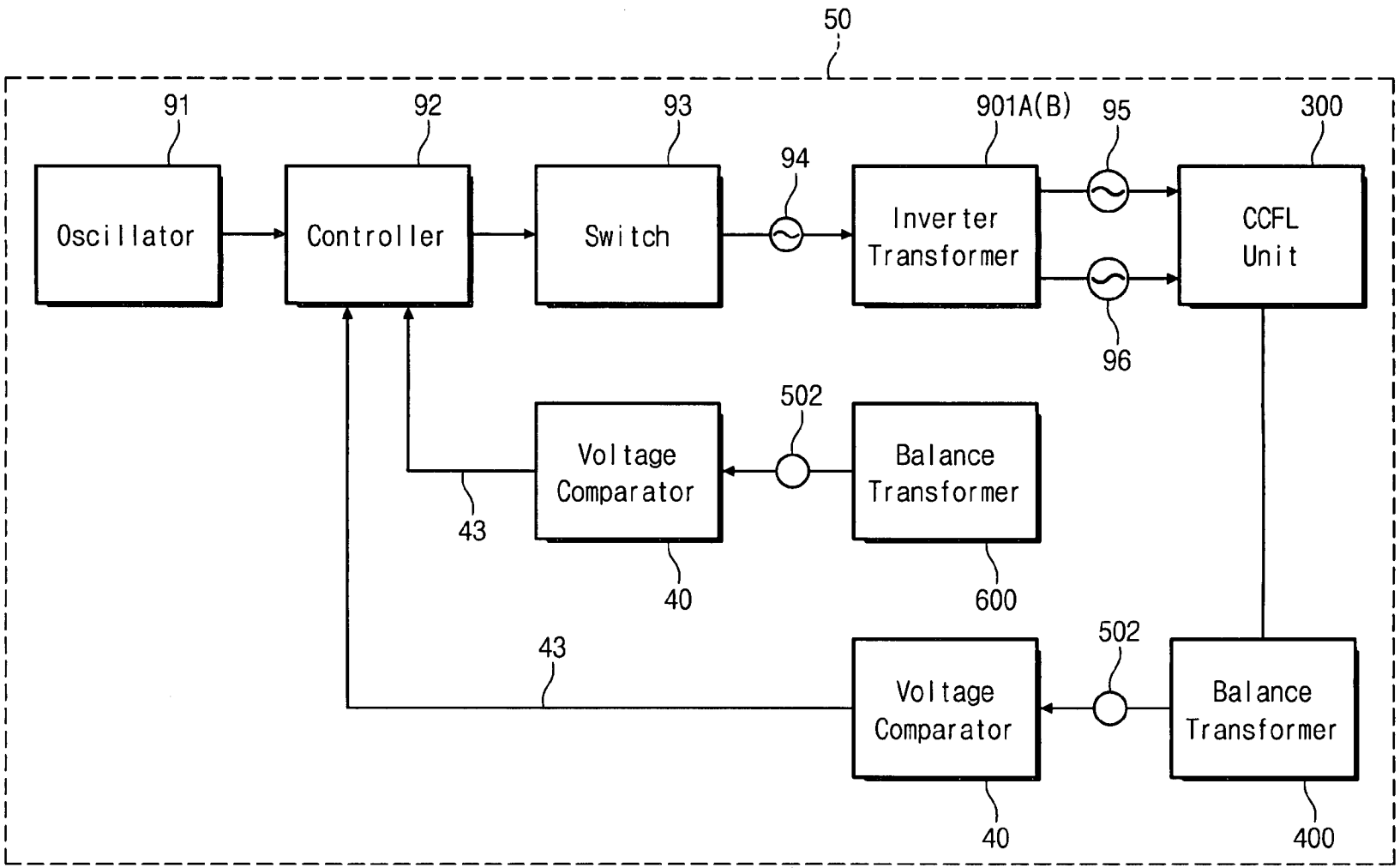
FIG. 12 is a block diagram showing an exemplary embodiment of an inverter unit and a backlight unit for use with the LCD display of FIG. 11.

FIG. 6 is a circuit diagram of an inverter circuit or backlight assembly (hereinafter, referred to as an inverter circuit) according to an embodiment of the present invention. FIG. 7 is a circuit diagram of an inverter circuit 1000 that is one illustrative unit among a plurality of inverter circuits illustrated in FIG. 6. FIG. 11 is a block diagram of an exemplary LCD including the inverter circuit. FIG. 12 is a block diagram of an exemplary inverter 90 and backlight assembly 30. In the inverter circuit 1000 of FIG. 7, the number N2 of turns in the secondary coil of the inverter transformer 901 is set to N1×V2/V1 (N1 indicates the number of turns in the primary coil of the inverter transformer 901) so as to obtain a high AC voltage V2 that drives a CCFL by applying AC voltages V1 94 generated from the inverter 90 of FIGS. 11 and 12 to the primary coil of the inverter transformer 901.

The secondary coil of the inverter transformer 901 is provided to output AC high voltages 95 and 96 having a phase differential therebetween of 180 degrees.

A first CCFL 301, a primary coil of a balance transformer 401, and a second CCFL 302 are connected in series across the AC high voltage 95 and the AC high voltage 96. Next, operation of balance transformers 400 inserted between two CCFLs in series will be described. The balance transformers 401 to 410 are arranged such that their primary coils have opposite polarities with respect to their secondary coils. In each of respective balance transformers 401 to 410, when a current flows through two CCFLs disposed at the primary coil of the balance transformer, a current flows through the primary coil of a corresponding balance transformer connected in series with the two CCFLs. This causes a current to flow through the secondary coils of the balance transformers 401 to 410. Because the secondary coils of the balance transformers 401 to 410 are connected in series with each other to form a loop, a current flowing through the loop of the secondary coils forces a current to flow through the primary coils of the respective balance transformers 401 to 410, so that the currents flowing through the respective CCFLs are controlled in the same manner.

In such a structure, one circuit node of the secondary coil loop of the balance transformers 401 to 410 is grounded, and the voltage detection node 501 is located on the loop. The secondary coil of at least one balance transformer is interposed between the voltage detection node 501 and the grounded node. A voltage sufficient for the balance transformers 401 to 410 to maintain balance of the CCFLs 301 to 310 is generated from the voltage detection node 501. A suitable voltage detection node 501 may be a circuit node on the loop where the number of the secondary coils of the balance transformers 401 to 410 is half the number of coils from the grounded node.

Next, operation of a balance transformer group 600 inserted between the secondary coil of the inverter transformer 901 and the ground will be described. The primary coil of the balance transformer 601 is arranged to have an opposite polarity with respect to the secondary coil of the balance transformer 601, and the primary coil of the balance transformer 602 is arranged to have substantially the same polarity with respect to the secondary coil of the balance transformer 602. As in the case of the balance transformer group 400, a current flowing through the secondary coils of two balance transformers 601 and 602 of the balance transformer group 600 forms a loop. In the balance transformers 601 and 602, when a current flows through the inverter transformer 901 connected to the primary coils of the balance transformers 601 and 602, a current also flows through the secondary coils of the balance transformers 601 and 602. Since the secondary coils of the two balance transformers 601 and 602 are connected in series to form the loop, a current flowing through the secondary coil of one balance transformer forces a current to flow through the primary coil of the other balance transformer. Consequently, the currents flowing through the secondary coils of the two inverter transformers having opposite phases are controlled such that these currents are flowing in the same direction.

FIG. 6 is a circuit diagram of an illustrative arrangement of a plurality of inverter circuits 1000 set forth in FIG. 7. Referring to FIG. 6, one node of the loop formed by the secondary coils of the balance transformers 601 to 610 is grounded, and a voltage detection node 502 is also located on the loop. The secondary coil of at least one balance transformer of the balance transformers 610 to 610 is interposed between the grounded node and the voltage detection node 502. A voltage sufficient for the balance transformer group 600 to maintain the balance of the CCFLs is generated from the voltage detection node 502. A suitable voltage detection node 501 is defined as a circuit node of the loop where the number of secondary coils of the balance transformers 601 to 610 from this circuit node to the grounded point is half the total number of secondary coils of the balance transformers 601 to 610.

According to the present configuration in which the balance transformer group 600 is inserted between the secondary coil of the inverter transformer 901 and ground, it is possible to detect an abnormal high voltage discharge occurring between a line disposed between the inverter transformer 901 and the CCFL 300 and another line, while it is virtually impossible to detect such an abnormal high voltage discharge at the voltage detection node 501 of the balance transformer group 400.

Figure 8:
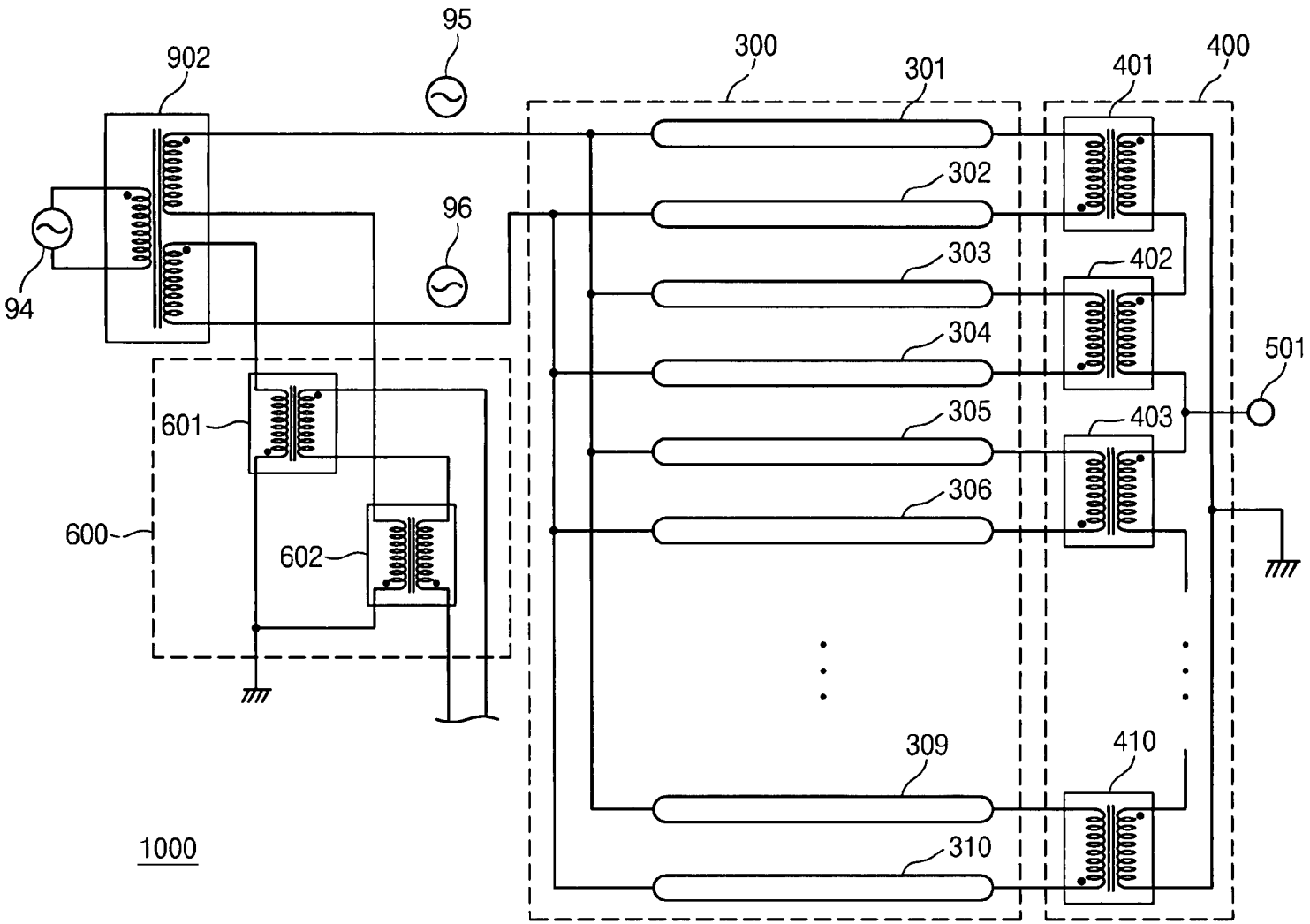
FIG. 8 is a circuit diagram showing an exemplary embodiment for an inverter transformer having a single primary coil for use in the inverter circuit of FIG. 6.

FIG. 8 is a circuit diagram of an inverter circuit according to another illustrative embodiment of the present invention. Unlike the inverter circuit of FIG. 7, an inverter transformer 902 has a single primary coil and two secondary coils. Such an inverter transformer 902 can be used to obtain almost the same effect as the inverter circuit of FIG. 7.

Figure 9:
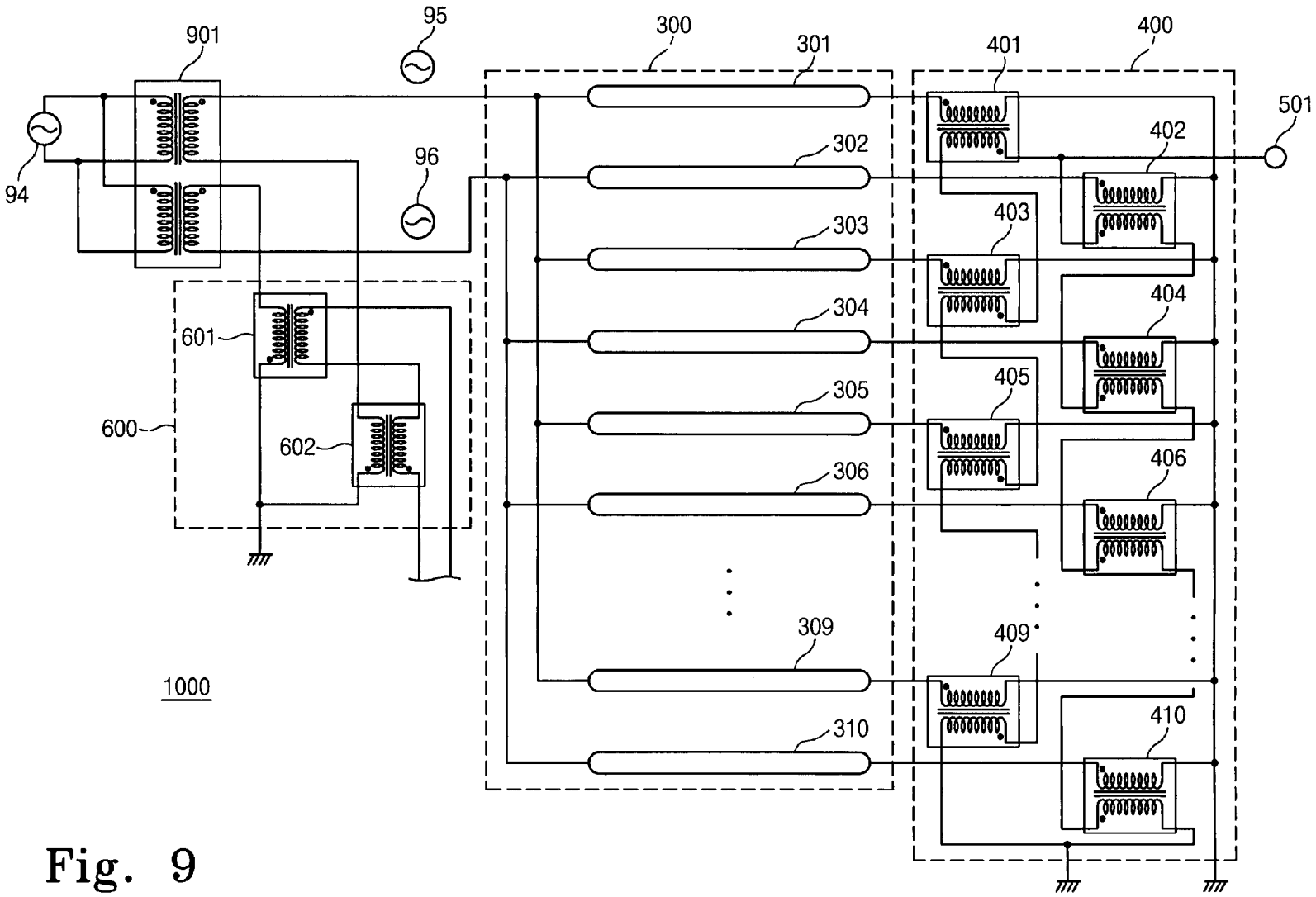
FIG. 9 is a circuit diagram showing another exemplary embodiment of a balance transformer connected to a discharge tube for use in the backlight assembly of FIG. 6.

FIG. 9 is a circuit diagram of an inverter circuit according to another illustrative embodiment of the present invention. Unlike the inverter circuit of FIG. 7, the terminals of the CCFLs 301 to 310 that are not connected to the inverter transformer 901 are grounded, with the primary coils of the balance transformers 401 to 410 being interposed. Also, when the AC voltage 95 has a reference phase, the other terminal of a plurality of parallel CCFLs driven by the AC voltage 95 of the reference phase and the other terminals of a plurality of parallel CCFLs driven by the AC voltage 96 of an opposite phase to the reference phase are grounded without being connected to one another. Further, a radiation noise caused by undesired emission of spurious radio frequency energy can be reduced by alternately arranging the CCFLs 301, 303, 305 to 309 turned on by the AC voltage 95 of the reference phase and the CCFLs 302, 304, 306 and 310 turned on by the AC voltage 96 having a phase opposite to the reference phase. Moreover, the structure of the balance transformer group 400 is different from that of the balance transformer group 400 illustrated in FIG. 7. The primary coils and the secondary coils of the balance transformers 401, 403, 405 and 409 are arranged to have opposite polarities, and the primary coils and the secondary coils of the balance transformers 402, 404, 406 and 410 are arranged to have the same polarities. As described above, the primary coils of the balance transformers 401 to 410 are inserted between a corresponding other terminal of a corresponding CCFL (this other terminal is the terminal which is not connected to the inverter transformer 901) and ground. The secondary coils of the balance transformers 401 to 410 are connected in series with each other to form the loop. One node of the loop is grounded, and the voltage detection node 501 is located on the loop. The secondary coil of at least one balance transformer is interposed between the grounded node and the voltage detection node 501. A voltage sufficient for the balance transformer group 400 to maintain the balance of the CCFLs 301 to 310 is generated from the voltage detection contact point 501. A suitable voltage detection contact point 501 may be defined as a circuit node of the loop where the number of the secondary coils of the balance transformers 401 to 410 from this circuit node to the grounded point is half the total number of secondary coils of the balance transformers 401 to 410.

Next, a device using the voltage detected at the voltage detection node 501 or 502 of the inverter circuit will be described.

Figure 10:
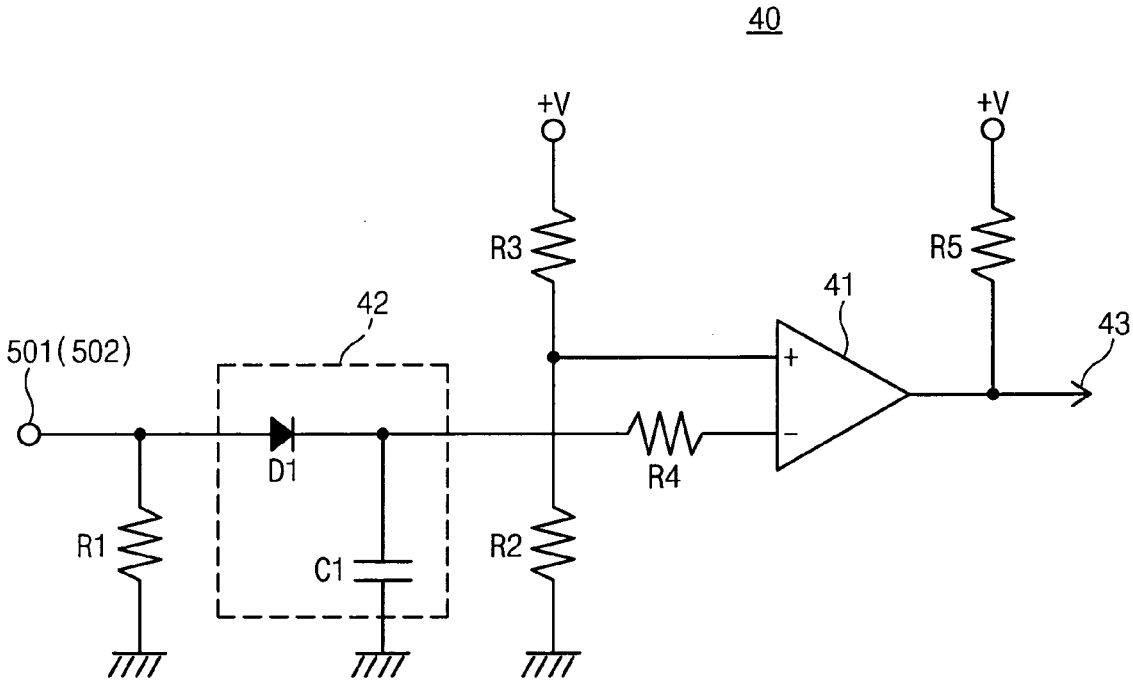
FIG. 10 is a circuit diagram showing an exemplary embodiment of a voltage comparator.

FIG. 10 is a circuit diagram of a voltage comparator comparing a reference voltage with a voltage detected at the voltage detection node 501 or 502.

Referring to FIG. 10, the voltage comparator 40 is illustratively implemented using a conventional comparator circuit. The voltage detected at the voltage detection node 501 maintains a somewhat constant level in a normal state, but exhibits a higher level in an abnormal state, for example, when a high-voltage abnormal discharge, such as a corona discharge, an arc discharge, etc., occurs between lines. Using this characteristic, it is possible to configure a system that can immediately avoid the high-voltage abnormal discharge by controlling the inverter. In the comparator circuit of FIG. 10, because a voltage detected at the voltage detection node 501 or 502 is an AC voltage, a rectifier 42 converts the detected voltage into a DC voltage, and a comparator 41 compares the DC voltage with a reference voltage and outputs a control voltage 43. In the comparator circuit of FIG. 10, when the detected voltage exceeds the reference voltage, the control voltage 43 output by the comparator 41 is, for example, a low level voltage. However, the control voltage 43 output by the comparator when the detected voltage exceeds the reference voltage may be either a low level voltage or a high level voltage according to the configuration of the comparator and according to the requirements of specific system applications. Also, comparing the detected voltage with the reference voltage is not limited to the specific embodiment shown in FIG. 10. For example, the detected voltage and the reference voltage may be compared by sampling a peak voltage without rectifying the detected voltage.

FIG. 11 is a block diagram of a lamp driver of an LCD having an inverter circuit according to an illustrative embodiment of the present invention.

Referring to FIG. 11, the LCD includes an AC/DC power supply 10 and an LCD module 20.

The AC/DC power supply 10 includes an AC/DC rectifier 12 and a DC/DC converter 13. The AC/DC power supply 10 converts an external AC voltage in an approximate range of about 100 V to 240 V into a DC voltage, and outputs the DC voltage to the LCD module 20.

The LCD module 20 includes a DC/DC converter 21, a common electrode voltage (Vcom) generator 22, a gamma voltage (y) generator 23, an LCD panel 24, an inverter circuit 90, and a backlight assembly 30. The LCD module 20 receives the DC voltage from the AC/DC power supply 10 and displays an image supplied from an external graphics controller (not shown).

The common electrode voltage generator 22 generates a common electrode voltage Vcom based on the DC voltage. The level of this DC voltage is shifted by the DC/DC converter 21, and the DC/DC converter 21 supplies the common electrode voltage Vcom to the LCD panel 24.

The gamma voltage generator 23 generates a gamma voltage Vdd based on the level-shifted DC voltage and supplies the gamma voltage to the LCD panel 24. Although the common electrode voltage generator 22 and the gamma voltage generator 23 are shown as being separated from the LCD panel 24 in FIG. 11, this is for illustrative purposes as one or both of the common electrode voltage generator 22 and the gamma voltage generator 23 may be included in the LCD panel 24.

As described above, the LCD includes the AC/DC power supply 10 and the LC module 20. When an abnormal state or condition such as an abnormal discharge occurs, the output voltage level of the AC/DC power supply 10 is controlled using the control voltage 43 (either a low level or a high level voltage as discussed previously) from the voltage comparator of FIG. 10 detected at the voltage detection node 501 or 502 of the inverter circuit of FIGS. 6 to 9. For example, the inverter circuit 90 is illustratively controlled by controlling a duty ratio of PWM oscillation, and the AC voltage supplied to the backlight assembly 30 is adjusted, thereby preventing a reduction in the lifetime of the CCFLs. Moreover, the balance transformer groups 400 and 600 may be embedded into the inverter circuit 90 or the backlight assembly 30 or both.

FIG. 12 is a block diagram of an inverter circuit 90 and a backlight assembly 30 in an LCD according to an illustrative embodiment of the present invention.

Referring to FIG. 12, the inverter circuit 90 and the backlight assembly 30 include an oscillator 91, a controller 92 connected to the oscillator 91, a switch 93 connected to the controller 92, an inverter transformer 901A/B connected between the switch 93 and the CCFL unit 300, a balance transformer 400 and a voltage comparator 40 connected in series between the CCFL unit 300 and the controller 92, and a balance transformer 600 and a voltage comparator 40 connected in series between the inverter transformer 901A/B and the controller 92.

When an abnormal state or condition, such as a corona discharge, an arc discharge, etc., occurs in the line between the secondary coil of the inverter transformer 901A/B and the CCFLs of the CCFL unit 300, or when an abnormal state such as an open circuit or a short circuit occurs due to a malfunction of one or more of the CCFLs of the CCFL unit 300, the controller 92 adjusts the driving frequency and driving voltage of the backlight assembly 30 according to the low level voltage or the high level voltage from the voltage comparator 40 that detects the voltage at the voltage detection nodes 501 and 502. For example, when the PWM oscillation is used to control the inverter circuit 90, the driving frequency and the driving voltage of the backlight assembly 30 are adjusted by controlling a pulse duty ratio. In this manner, when the abnormal state or condition such as a corona discharge occurs in the line disposed between the secondary coil of the inverter transformer 901A/B and the CCFLs and another line, or when an abnormal state such as an open circuit or short circuit due to the damage of the CCFLs occurs, the foregoing abnormal states can be immediately avoided.

In addition, the present invention can improve the performance of the LCD by applying the inverter circuit to the LCD.

Figure 13:
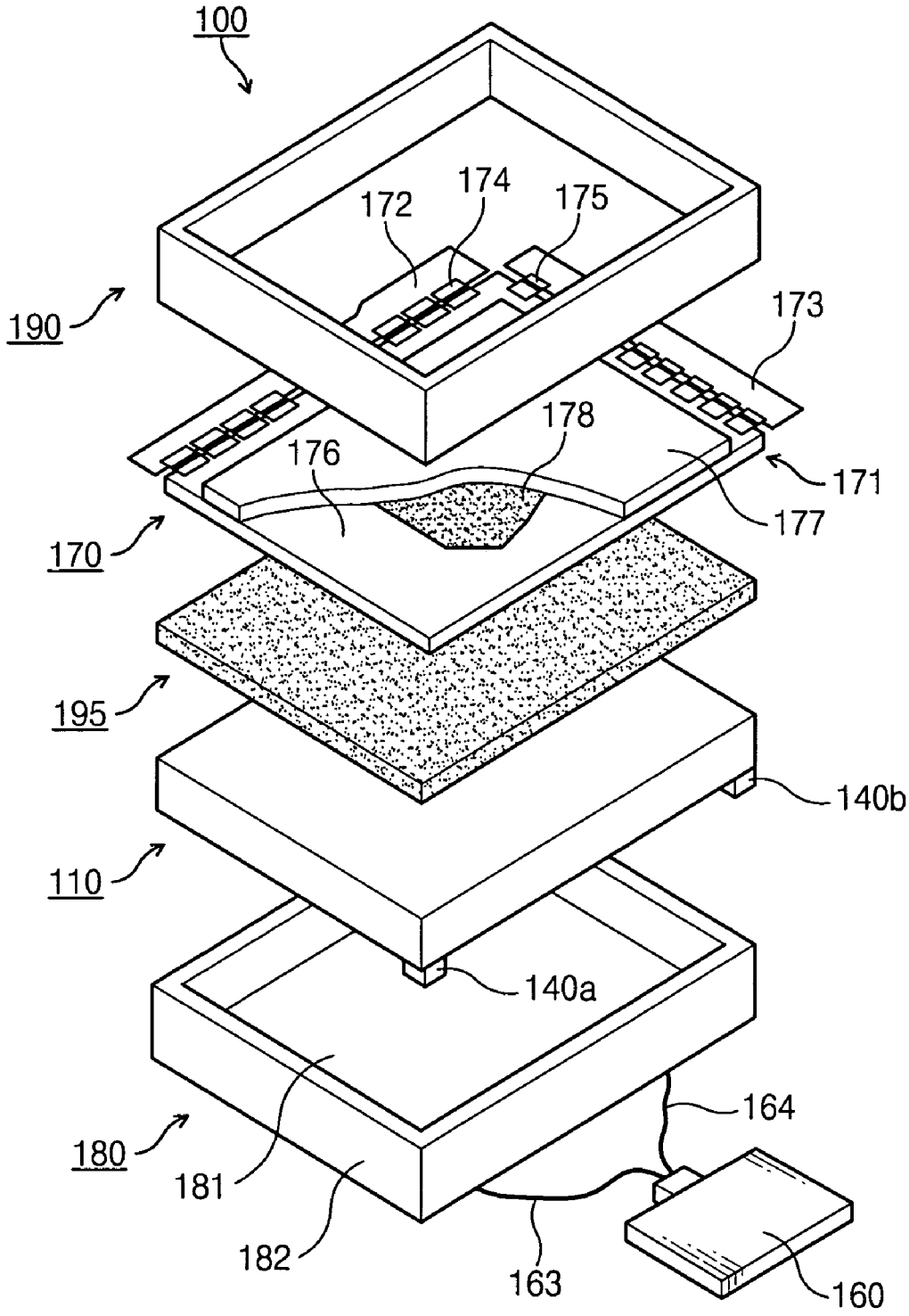
FIG. 13 is an exploded perspective view showing an exemplary embodiment of an LCD display.

FIG. 13 is an exploded perspective view of an LCD according to an illustrative embodiment of the present invention. Specifically, FIG. 13 illustrates a mechanical structure of the LCD, and is not intended to show the electrical circuit configuration for the LCD.

Referring to FIG. 13, the LCD 100 includes a backlight assembly 110, a display unit 170, and a case 180.

The display unit 170 includes a liquid crystal panel 171 that displays an image, and a data printed circuit 172 and a gate printed circuit 173 that both generate driving signals to drive the liquid crystal panel 171. The data printed circuit 172 and the gate printed circuit 173 are electrically connected to the liquid crystal panel 171, illustratively through a data tape carrier package (TCP) and a gate TCP 175, respectively.

The liquid crystal panel 171 includes a thin film transistor ("TFT") substrate 176, a color filter substrate 177 disposed to face the TFT substrate 176, and a liquid crystal layer 178 interposed between the TFT substrate 176 and the color filter substrate 177.

The TFT substrate 176 is a transparent glass substrate in which switching TFTs (not shown) are arranged in a matrix. Source terminals and gate terminals of the TFTs are connected to data lines and gate lines, respectively. Also, a common electrode (not shown) formed of a transparent conductive material is connected to drain terminals of the TFTs.

For example, the color filter substrate 177 may include red, green, and blue ("RGB") pixels (not shown) that are formed using a thin film process. The color filter substrate 177 includes the common electrode.

The case 180 has a bottom plate 181 and sidewalls 182 extending from edges of the bottom plate 181 to provide a receiving space. The case 180 receives the backlight assembly 110 and the liquid crystal panel 171.

The bottom plate 181 has a size sufficient to receive the backlight assembly 110. It is acceptable if similar or identical shapes are used for the bottom plate 181 and the backlight assembly 110. In this embodiment, the bottom plate 181 and the backlight assembly 110 have a rectangular plate-like shape. The sidewalls 182 are extended from the edges of the bottom plate 181 in a substantially vertical direction so that the backlight assembly 110 cannot be readily released from the case 180.

In this embodiment, the LCD 100 further includes an inverter circuit 160 and a top chassis 190.

The inverter circuit 160 is disposed outside the case 180 to generate a discharge voltage to drive the backlight assembly 110. The discharge voltage generated from the inverter circuit 160 is applied to the backlight assembly 110 through a first voltage line 163 and a second voltage line 164. The first voltage line 163 and the second voltage line 164 are electrically connected to a first electrode 140*a* and a second electrode 140*b* formed on either or both sides of the backlight assembly 110. The first voltage line 163 and the second voltage line 164 may be directly connected to the first electrode 140*a* and the second electrode line 140*b*. Also, the first voltage line 163 and the second voltage line 164 may be connected to the first electrode 140*a* and the second electrode line 140*b* through an additional connecting member (not shown). Moreover, the balance transformer groups 400 and 600 may be built in the inverter circuit 160 or the backlight assembly 110.

The top chassis 190 is coupled to the case 180 while surrounding the edges of the liquid crystal panel 171. The top chassis 190 can prevent the liquid crystal panel 171 from being damaged due to externally applied mechanical impacts. Also, the top chassis 190 can prevent the liquid crystal panel from being released from the case 180.

The liquid crystal panel 100 may further include at least one optical sheet 195 so as to improve characteristics of light emitted from the backlight assembly 110. The optical sheet 195 may optionally include at least one of a diffusion sheet to diffuse the light, or a prism sheet to condense the light.

According to the present invention, when an abnormal state or condition such as a corona discharge occurs in the line between the secondary coil of the inverter transformer and the discharge tube, the current flows through the primary coil of the balance transformer serially connected to the inverter transformer. The current then flows through the secondary coil of the balance transformer, thereby changing an electrical load applied to the reference phase or the reverse phase attributable to the serial insertion of the balance circuit between the secondary coil of the inverter transformer and ground. Since the secondary coil is connected in series to the secondary coil of another balance transformer, the current flowing through the secondary coil forces the current to flow through the primary coil of each balance transformer. Consequently, the currents of the respective inverter transformers are controlled to flow in the same direction. A voltage necessary to maintain the balance of the balance transformer is generated by detecting the voltage at the contact node (detection node) located on the loop of the secondary coils of the balance transformers in a state wherein one node of the secondary coil is grounded. Using this characteristic, it is possible to detect an abnormal state of high voltage discharge such as a corona discharge between the lines disposed between the secondary coil of the inverter transformer and the CCFL and another line.

Also, it is possible to detect an abnormal state or condition such as an open circuit or a short circuit caused by current concentration on a specific CCFL and the resulting malfunction of the CCFLs.

In addition, abnormal discharges, such as a corona discharge caused when a failure occurs between the line disposed between the secondary coil of the inverter transformer and the CCFL and another line, and abnormal states such as an open circuit or a short circuit caused by current concentration on a specific CCFL and consequent damage to the CCFLs may be detected in the form of voltages using the inverter circuits and comparing these detected voltages with the reference voltage. When the detected voltage exceeds the reference voltage, the comparator outputs the control signal (the control signal may be in the form of either a high level voltage or low level voltage). Therefore, an abnormal state or condition can be immediately or promptly avoided by stopping the driving of the inverter or controlling the driving voltage.

It will be apparent to those skilled in the art that various modifications and variations can be made to the present invention. Thus, it is intended that the present invention cover such modifications and variations, the invention being characterized with reference to the scope of the appended claims and equivalents thereof.

What is claimed is:

1. An inverter circuit comprising:

a plurality of inverter transformers that supplies AC voltage to a plurality of discharge tubes, the inverter transformers being arranged such that the AC voltage at a respective first terminal of each secondary coil has a substantially opposite polarity with respect to the AC voltage at a corresponding second terminal of each secondary coil; and a plurality of balance transformers having primary coils inserted in series between a reference terminal of the secondary coils of the inverter transformers and ground, wherein the secondary coils of the balance transformers are connected in series to form a loop, one circuit node of the loop being grounded;

a voltage detection node being located on the loop; and at least one secondary coil of the secondary coils of the balance transformers interposed between the grounded node of the loop and the voltage detection node.

2. The inverter circuit of claim 1, wherein the voltage detection node is a node on the loop where half of the secondary coils of the balance transformers are interposed between the voltage detection node and the grounded node.

3. The inverter circuit of claim 1, wherein each of the inverter transformers has two primary coils and two secondary coils, and a first secondary coil of the two secondary coils is arranged to have an AC voltage of opposite polarity with respect to a second secondary coil of the two secondary coils.

4. The inverter circuit of claim 1, wherein each of the inverter transformers has a single primary coil and two secondary coils, and wherein a first secondary coil of the two secondary coils is arranged to have an AC voltage of opposite polarity with respect to a second secondary coil of the two secondary coils.

5. The inverter circuit of claim 1, wherein the discharge tubes include a first discharge tube and a second discharge tube;

the first discharge tube, the primary coils of the balance transformers, and the second discharge tube are connected in series across opposite polarity AC voltages outputted from the secondary coils of the inverter transformers; and the secondary coils of the balance transformers are connected in series to form the loop.

6. The inverter circuit of claim 5, wherein the primary coils of the balance transformers are connected in series between ground and corresponding terminals of each of the discharge tubes that are not connected to the inverter transformers.

7. The inverter circuit of claim 6, further comprising a comparator to compare a voltage of the voltage detection node with a predetermined reference voltage, the comparator generating a control voltage at either a low level or a high level in response to the voltage of the voltage detection node being higher than the reference voltage.

8. The inverter circuit of claim 7, wherein the inverter circuit compares the voltage of the voltage detection node with the reference voltage and adjusts a current supplied to the discharge tubes based on the comparison, wherein the adjustment includes cutting off a voltage supplied to the discharge tubes as a function of the comparison.

9. A backlight assembly comprising:

a plurality of discharge tubes;

a plurality of inverter transformers that supply AC voltage to the plurality of discharge tubes, the inverter transformers being arranged such that the AC voltage at a first terminal of each secondary coil has an opposite polarity with respect to the AC voltage at a second terminal of each secondary coil; and a plurality of balance transformers having primary coils inserted in series between corresponding reference terminals of the secondary coils of the inverter transformers and ground, wherein the secondary coils of the balance transformers are connected in series to form a loop, one node of the loop being grounded;

a voltage detection node being located on the loop; and at least one secondary coil of the secondary coils of the balance transformers is interposed between the grounded node of the loop and the voltage detection node.

10. The backlight assembly of claim 9, wherein the discharge tubes are cold cathode fluorescent lamps (CCFLs).

11. The backlight assembly of claim 9, wherein the voltage detection node is a circuit node on the loop where half of the secondary coils of the balance transformers are interposed between the voltage detection node and the grounded node.

12. The backlight assembly of claim 9, wherein each of the inverter transformers has two primary coils and two secondary coils, wherein a first secondary coil of the two secondary coils is arranged to have an AC voltage of opposite polarity with respect to a second secondary coil of the two secondary coils.

13. The backlight assembly of claim 10, wherein each of the inverter transformers has a single primary coil and two secondary coils, wherein a first secondary coil of the two secondary coils is arranged to have an AC voltage of opposite polarity with respect to a second secondary coil of the two secondary coils.

14. The backlight assembly of claim 9, wherein the discharge tubes include a first discharge tube and a second discharge tube;

the first discharge tube, the primary coils of the balance transformers, and the second discharge tube are connected in series across opposite polarity AC voltages outputted from the secondary coils of the inverter transformers;

the secondary coils of the balance transformers are connected in series to form the loop.

15. The backlight assembly of claim 14, wherein the primary coils of respective balance transformers are connected in series between ground and a corresponding terminal of each discharge tube that is not connected to any inverter transformer.

16. The backlight assembly of claim 14, further comprising a comparator to compare the voltage of the voltage detection node with a predetermined reference voltage, and the comparator generates a control voltage at either a low level or a high level when the voltage of the voltage detection node is higher than the reference voltage.

17. The backlight assembly of claim 16, wherein the backlight assembly compares the voltage of the voltage detection node with the reference voltage and adjusts a current supplied to the discharge tubes based on the comparison, wherein the comparison includes cutting off a voltage supplied to the discharge tubes as a function of the comparison.

18. A liquid crystal display comprising:

a liquid crystal panel to display an image on the liquid crystal display, the liquid crystal panel comprising:

a plurality of gate lines;

a plurality of data lines approximately orthogonal to the gate lines;

a plurality of switching elements connected to the gate lines and the data lines; and a liquid crystal element connected to the switching elements, an inverter circuit comprising:

a plurality of inverter transformers that supplies AC voltage to a plurality of discharge tubes, the inverter transformers each having a secondary coil, the inverter transformers being arranged such that a first terminal of each secondary coil has an AC voltage of opposite polarity with respect to a second secondary terminal of each secondary coil; and a plurality of balance transformers having primary coils inserted in series between a reference terminal of each secondary coil of the inverter transformers and ground, wherein the secondary coils of the balance transformers are connected in series to form a loop, one node of the loop being grounded;

a voltage detection node being located on the loop; and at least one secondary coil of the secondary coils of the balance transformers being interposed between the grounded node of the loop and the voltage detection node.

19. A liquid crystal display comprising:

a display unit having a liquid crystal panel, a data circuit and a gate circuit connected to the liquid crystal panel;

a backlight assembly having a plurality of discharge tubes;

a case for receiving the backlight assembly;

a top chassis protecting the liquid crystal panel from externally applied mechanical impacts;

at least one optical sheet disposed between the liquid crystal panel and the backlight assembly; and an inverter circuit comprising:

a plurality of inverter transformers that supplies AC voltage to a plurality of discharge tubes, the inverter transformers being arranged such that the AC voltage at a respective first terminal of each secondary coil has a substantially opposite polarity with respect to the AC voltage at a corresponding second terminal of each secondary coil; and a plurality of balance transformers having primary coils inserted in series between a reference terminal of the secondary coils of the inverter transformers and ground, wherein the secondary coils of the balance transformers are connected in series to form a loop, one node of the loop being grounded;

a voltage detection node being located on the loop; and at least one secondary coil of the secondary coils of the balance transformers being interposed between the grounded node of the loop and the voltage detection node.

20. The liquid crystal display of claim 18 for use in a liquid crystal monitor.

21. The liquid crystal display of claim 19 for use in a liquid crystal monitor.

22. The liquid crystal display of claim 18 for use in a liquid crystal television set.

23. The liquid crystal display of claim 19 for use in a liquid crystal television set.

24. A liquid crystal display comprising:

a liquid crystal panel to display an image, the liquid crystal panel comprising:

a plurality of gate lines;

a plurality of data lines approximately orthogonal to the gate lines;

a plurality of switching elements connected to the gate lines and the data lines;

a liquid crystal element connected to the switching elements; and a backlight assembly comprising:

a plurality of discharge tubes;

a plurality of inverter transformers that supply AC voltage to the plurality of discharge tubes, the inverter transformers being arranged such that the AC voltage at a respective first terminal of each secondary coil has a substantially opposite polarity with respect to the AC voltage at a corresponding second terminal of each secondary coil; and a plurality of balance transformers having primary coils inserted in series between a reference terminal of the secondary coils of the inverter transformers and ground, wherein the secondary coils of the balance transformers are connected in series to form a loop, one node of the loop being grounded;

a voltage detection node being located on the loop; and at least one secondary coil of the secondary coils of the balance transformers being interposed between the grounded node of the loop and the voltage detection node.

25. A liquid crystal display comprising:

a display unit having a liquid crystal panel, a data circuit and a gate circuit connected to the liquid crystal panel;

a backlight assembly having a plurality of discharge tubes;

a case for receiving the backlight assembly;

a top chassis for protecting the liquid crystal panel from externally applied mechanical impacts; and at least one optical sheet disposed between the liquid crystal panel and the backlight assembly, the backlight assembly comprising:

a plurality of inverter transformers that supply AC voltage to the plurality of discharge tubes, the inverter transformers being arranged such that the AC voltage at a respective first terminal of each secondary coil has an opposite polarity with respect to the AC voltage at a corresponding second terminal of each secondary coil; and a plurality of balance transformers having primary coils inserted in series between a reference terminal of the secondary coils of the inverter transformers and ground, wherein the secondary coils of the balance transformers are connected in series to form a loop, one node of the loop being grounded;

a voltage detection node being located on the loop; and at least one secondary coil of the secondary coils of the balance transformers being interposed between the grounded node of the loop and the voltage detection node.

* * * * *